United States Patent [19]

Williams

[11] Patent Number: 4,876,827

[45] Date of Patent: Oct. 31, 1989

[54] GUTTER ASSEMBLY

[76] Inventor: Robert D. Williams, Box 95, Lumby, British Columbia, Canada, V0E 2G0

[21] Appl. No.: 190,455

[22] Filed: Jan. 3, 1989

[51] Int. Cl.[4] ..... E04D 13/06

[52] U.S. Cl. ..... 52/12; 248/48.1; 248/48.2; 52/96; 210/474

[58] Field of Search ..... 52/11, 12, 94–96; 248/48.1, 48.2; 210/474

[56] References Cited

U.S. PATENT DOCUMENTS 836,012 11/1906 Cassen ..... 52/12

2,271,081 1/1942 Layton ..... 248/28.2

3,388,555 6/1968 Foster ..... 52/12

4,411,110 10/1988 Carey ..... 52/11

*Primary Examiner*—James L. Ridgill, Jr.

*Attorney, Agent, or Firm*—Harpman & Harpman

[57] ABSTRACT

A gutter assembly with a leaf and pine needle guard for attachment along the roof edge of a structure. Mounting brackets are provided for securing the assembly to the structure along its length. The gutter assembly includes a curved water shed surface with a plurality of openings along its vertical portion which selectively allow the water to enter the gutter positioned below while excluding pine needles, leaves and other debris from engagement within the gutter.

5 Claims, 2 Drawing Sheets

GUTTER ASSEMBLY

BACKGROUND OF THE INVENTION

1. Technical Field

This device relates to rain gutters in general and specifically to guards or screens that are used to restrict the access of the gutter to only water, eliminating the majority of debris, such as leaves, etc.

2. Description of Prior Art

Prior Art devices of this type have relied on a variety of different structural variations to strain debris from the water entering the gutter system, see for example U.S. Pat. No. 3,388,555, U.S. Pat. No. 4,497,146, U.S. Pat. No. 2,583,422 and U.S. Pat. No. 4,631,875.

In U.S. Pat. No. 2,583,422 a guard is disclosed having a gutter cover having a plurality of raised areas along its upper surface which are apertured therebelow thereby excluding debris from entering the gutter.

In U.S. Pat. No. 3,388,555 a self-straining eave trough is shown having a curved upper portion and an integral gutter formed therebelow. A plurality of spaced tabs are cut into the lower area of the curved portion which allow for water to enter the gutter while preventing debris from entering.

U.S. Pat. No. 4,497,146 discloses hangers for rain gutters which extend from the roof line in a curved fashion down to and engage the gutter, preventing debris from entering the gutter interior.

Finally, in U.S. Pat. No. 4,631,875 a gutter assembly is disclosed having a leaf guard that extends from under the shingles on a roof at the same angle to form a forward wall of a gutter portion with the angled portion having a plurality of slots which allow access of water, but keeps the debris from entering the gutter itself.

SUMMARY OF THE INVENTION

A gutter assembly to prevent leaves, pine needles and other debris from entering the gutter. The gutter assembly provides a substantially vertically aligned apertured surface guiding the water into the gutter while diverting debris harmlessly away.

DESCRIPTION OF THE PREFERRED EMBODIMENT

Figure 1:
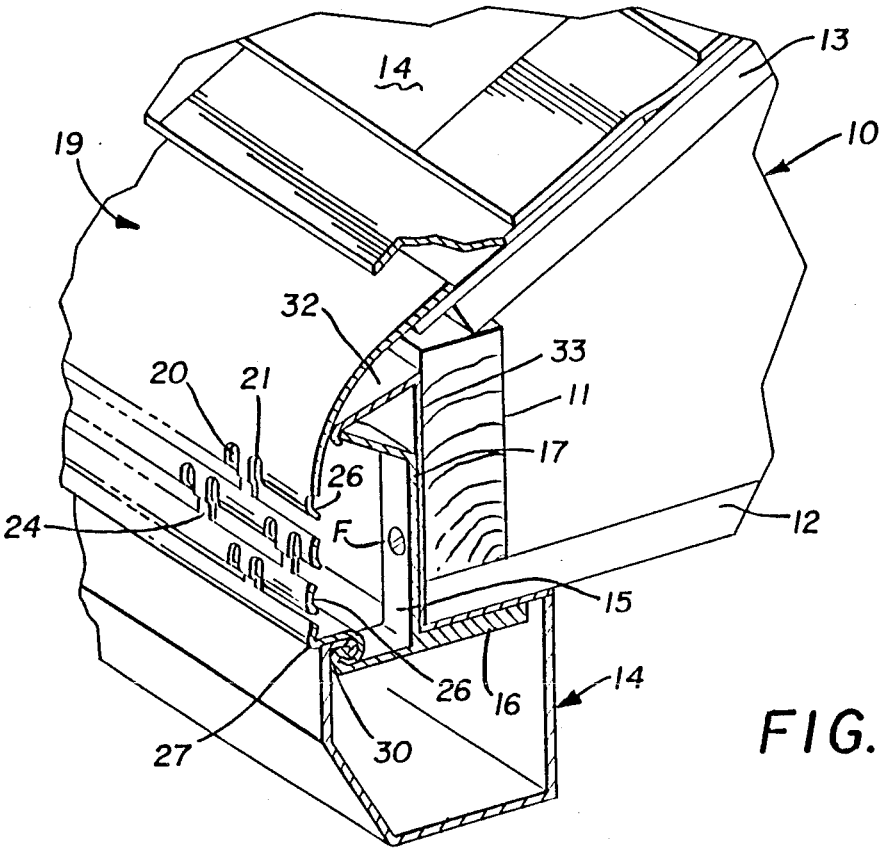
FIG. 1 is a perspective view of a gutter assembly on a structure.
Figure 2:
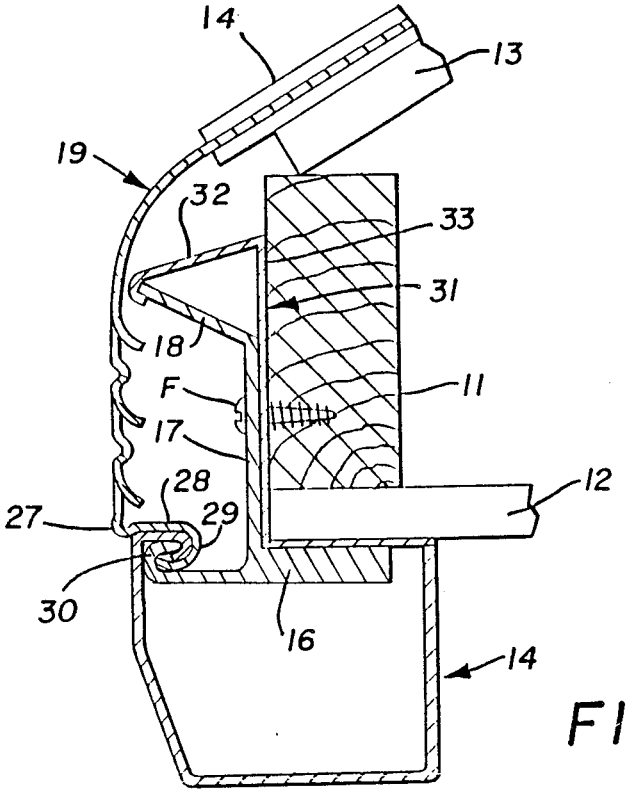
FIG. 2 is a cross-sectional view of the gutter assembly in FIG. 1.
Figure 3:
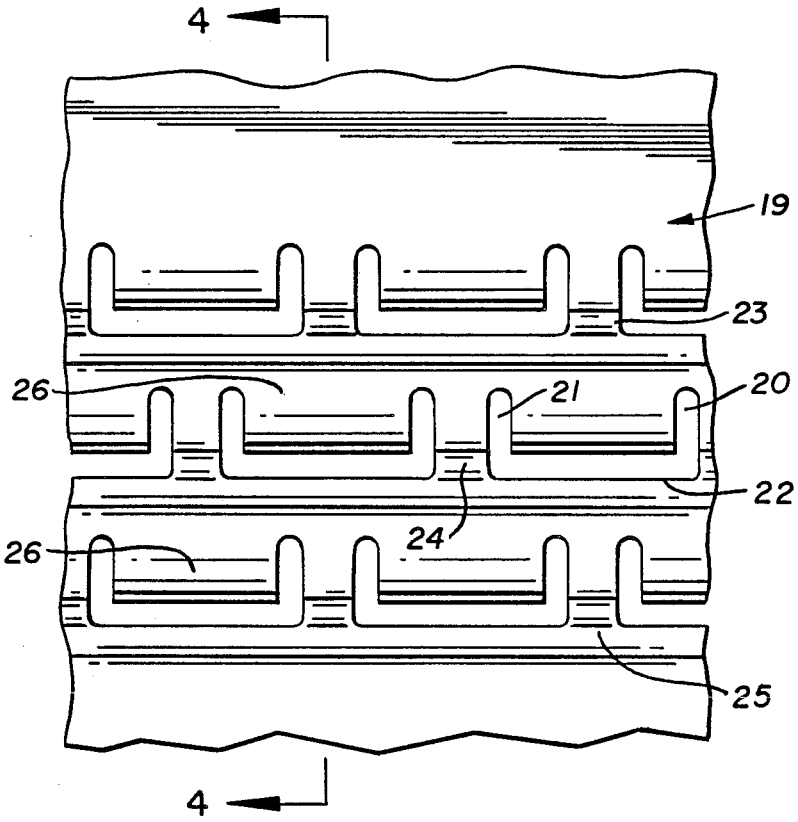
FIG. 3 is an enlarged portion of the gutter assembly showing a plurality of shaped openings in the vertical surface.
Figure 4:
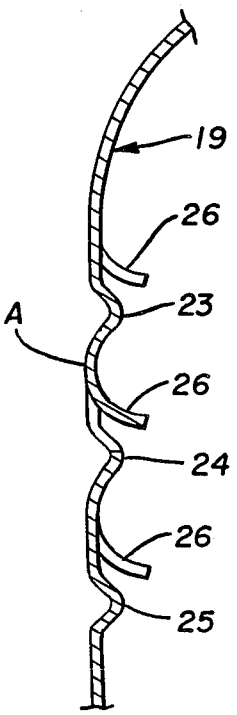
FIG. 4 is a cross section on lines 4—4 of FIG. 1.

Referring now to FIGS. 1 and 2 of the drawings a gutter assembly can be seen mounted to a portion of a roof structure 10 comprising a fascia board 11, a soffit 12 and a roof deck 13. A plurality of shingles 40 are overlappingly attached to the roof deck 13 as will be well understood by those skilled in the art. The gutter assembly is comprised of an elongated trough portion 14 that has a generally U-shaped configuration that extends along the roof structure 10 just below the soffit 12. A plurality of attachment clips 15 are positioned in longitudinally spaced relation to one another along the fascia board 11 by fasteners F. Each of the attachment clips 15 comprises a horizontally disposed base member 16 with an upstanding attachment member 17 thereon. The attachment member 17 has an angularly disposed free end portion 18 that acts as a first spacer support for the gutter assembly as will be described in greater detail later. The attachment member 17 is apertured midway along its length for acceptance of a fastener F engaging the fascia board 11. An elongated water shed portion 19 having an inclined upper wall and a substantially vertical lower wall joined by an integral curved wall extends from under the shingles 40 on the roof deck 13 outwardly and downwardly in a smooth continuous manner and engages the trough portion 14, as best seen in FIG. 2 of the drawings. A plurality of longitudinally and vertically spaced openings 20 in a multiple row pattern, best seen in FIGS. 2, 3, and 4 of the drawings are formed in the lower wall of said water shed portion 19. Each of the spaced openings 20 defined by vertical slots 20 and 21 interconnected by a horizontally disposed slit 22 the openings 20 being staggered vertically and aligned horizontally in vertically spaced rows. Each of the rows of the spaced openings 20 are formed between longitudinally extending inwardly recessed curved areas in the lower wall at 23, 24, and 25 respectively. The wall material between the slots 20 and 21 and above the slits 22 defines a compound curved inturned flange at 26 the apex A of which falls within substantially vertical plane defined by the lower wall of the water shed portion 19. The inwardly recessed curved areas 23, 24 and 25 form continuing curved surfaces of the curved inturned flanges 26 above the apex A so as to form in combination smooth curving surfaces that guide water from the shingles 40 around the water shed portion 19 and onto the compound curved inturned flanges 26 diverting and channeling the water into the trough portion 14. The lower horizontal edge 27 of said lower wall of said water shed 19 portion has inturned horizontal and vertical flange elements 28 and 29 to conform to and engage with an upper rolled edge 30 of the trough 14 abutting said base member 16 of the clips 15.

A secondary spacer support 31 is formed by an elongated angularly disposed member 32 extending from a vertical portion 33 abutting the fascia board 11 behind the space clips 15 positioned therealong. The vertical portion 33 of the secondary spacer support 31 extends downwardly over and inunder said soffit 12 being held thereagainst by said spacer clips 15, best seen in FIGS. 1 and 2 of the drawings.

It will be evident from the above description that in use the gutter assembly will effectively separate water from a variety of undesirable debris, such as leaves, pine needles, etc. thus keeping the trough 14 free and open reducing the need to clean out the trough periodically as is now required.

Figure 5:
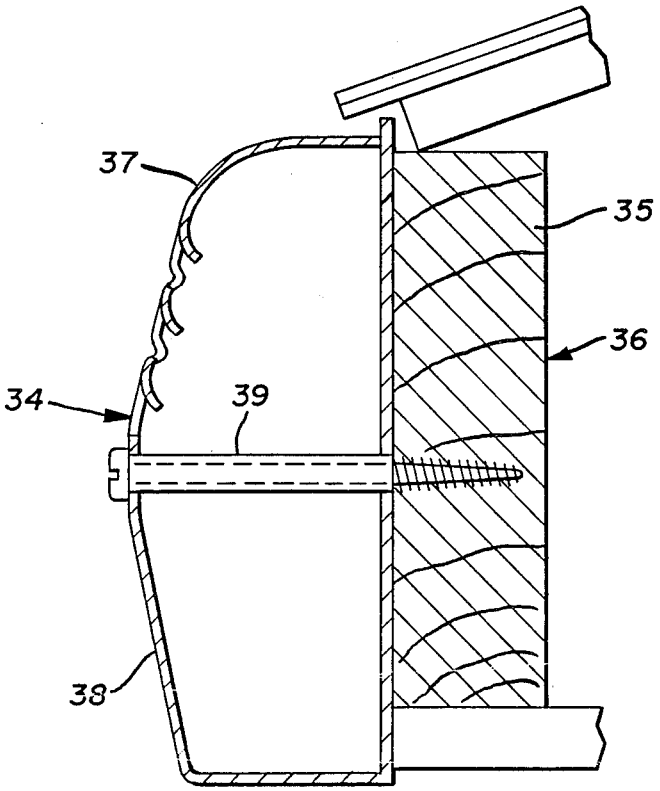
FIG. 5 is a cross-sectional view of an alternate form of the invention.

Referring now to FIG. 5 of the drawings an alternate form of the gutter assembly can be seen comprised of a one-piece trough and water shed combination 34 secured to a fascia board 35 of a structure 36. In this form of the invention a continuous elongated water shed portion 37 is defined having a trough 38 integrally formed therewith. The same multiple slot configuration is formed within the substantially vertical portion of the water shed 37 portion as described above with a screw and furl 39 securing the assembly to the fascia board 35 as will be well known and understood by those skilled in the art.

Thus, it will be seen that a new and useful gutter assembly has been illustrated and described and that various changes and modifications may be made therein without departing from the spirit of the invention.

Therefore, I claim:

1. An improvement in a gutter assembly for a roof structure which includes a fascia board having a vertical outer surface and a roof deck inclinded towards the fascia board, the improvement commprising an elongated trough portion and an elongated water shed portion, a plurality of clips securing said trough portion to said roof structure, said water shed portion comprising an upper wall engaging said roof deck and a lower wall in a substantially vertical plane extending to said trough portion with an integral curved wall joining said upper and lower walls, a plurality of vertically spaced rows of horizontally spaced vertical slots and horizontal slits connecting pairs of said vertical slots in said lower wall defining flanges in said lower wall between said vertical slots and above said horizontal slits, each of said flanges being inturned and curved, the apex of each of said curved flanges being within the substantially vertical plane of said lower wall, a plurality of vertically spaced, longitudinally extending recessed curved areas between each of said rows defining a portion of each of said inturned curved flanges whereby water flowing downwardly on said water shed portion will follow said recessed curved areas and said inturned curved flanges into said trough portion.

2. The improvement in the gutter assembly of claim 1 wherein said inturned curved flanges extend inwardly to a point beyond said substantially vertical plane formed by said longitudinally extending recessed curved areas.

3. The improvement in the gutter assembly of claim 1 wherein attachment means on said lower wall of said water shed portion engages said trough portion.

4. The improvement in the gutter assembly of claim 1 wherein said pairs of vertical slots and connecting horizontal slits in each of said rows are staggered longitudinally with respect to the vertical slots and horizontal slits of an adjacent row.

5. The improvement in the gutter assembly of claim 1 wherein an elongated member is positioned on said fascia board above said trough portion and an elongated angularly disposed member extends from said vertical member defining a spacer and support for said water shed portion.

* * * * *